United States Patent [19]

Wada et al.

[11] Patent Number: 4,812,835

[45] Date of Patent: Mar. 14, 1989

[54] DISPLAY SEGMENT CONFIGURATION SUITABLE FOR CELSIUS AND FAHRENHEIT THERMOMETER

[75] Inventors: Yoshihiro Wada, Nara; Ryoichi Fujii, Kyoto, both of Japan

[73] Assignee: Sharp Kabushiki Kaisha, Osaka, Japan

[21] Appl. No.: 81,611

[22] Filed: Aug. 3, 1987

Related U.S. Application Data

[63] Continuation of Ser. No. 670,891, Nov. 13, 1984, abandoned.

[30] Foreign Application Priority Data

Nov. 17, 1983 [JP] Japan ..... 58-217552

[51] Int. Cl.[4] ..... G09G 3/04

[52] U.S. Cl. ..... 340/756; 340/762; 340/765; 374/170

[58] Field of Search ..... 340/756, 763, 765, 792, 340/762, 815.09; 374/170, 171

[56] References Cited

U.S. PATENT DOCUMENTS

| | | | |
|---|---|---|---|
| 3,897,643 | 8/1975 | Morris, Jr. et al. . | |
| 3,903,519 | 9/1975 | Zega . | |
| 3,925,977 | 12/1975 | Maezawa | 340/756 |
| 3,940,595 | 2/1976 | Turner | 340/756 |
| 3,971,012 | 7/1976 | Morokawa et al. | 340/756 |
| 4,008,950 | 2/1977 | Chapman et al. . | |
| 4,026,103 | 5/1977 | Ichikawa et al. | 340/756 |
| 4,309,699 | 1/1982 | Tauer | 340/756 |
| 4,447,884 | 5/1984 | Wada . | |
| 4,536,851 | 8/1985 | Germanton et al. | 374/170 |
| 4,565,456 | 1/1986 | Iida et al. . | |
| 4,588,307 | 5/1986 | Palti | 374/170 |
| 4,611,897 | 9/1986 | Hara et al. | 340/756 |

FOREIGN PATENT DOCUMENTS

| | | | |
|---|---|---|---|
| 2061586 | 5/1981 | United Kingdom | 340/756 |

OTHER PUBLICATIONS

"Elektor", issue Jul./Aug. 1977, pp. 32–33.

*Primary Examiner*—Gerald L. Brigance
*Attorney, Agent, or Firm*—Birch, Stewart, Kolasch & Birch

[57] ABSTRACT

A segment arrangement suitable for a Celsius and Fahrenheit clinical thermometer comprises two upper digit displays and two lower digit displays. The upper digit displays can merely display four figures "3", "4", "9", and "10". The lower digit displays can display "00" through "99" figures, so as to display 35.0–42.0 degrees Centigrade and 96.8–105.8 degrees Fahrenheit. The two upper digit displays have such a specific configuration that a first digit display is provided which comprises a vertical major segment and a second digit display is provided which comprises two vertical minor segments, three horizontal segments, and one vertical major segment. The vertical major segment of the first digit display is electrically coupled to one of the two vertical minor segments.

9 Claims, 1 Drawing Sheet

DISPLAY SEGMENT CONFIGURATION SUITABLE FOR CELSIUS AND FAHRENHEIT THERMOMETER

This application is a continuation of application Ser. No. 670,891 filed on Nov. 13, 1984, now abandoned.

BACKGROUND OF THE INVENTION

The present invention relates to a display segment and, more particularly, to a display segment configuration for displaying celsius and fahrenheit temperatures in a thermometer such as a clinical thermometer.

Conventionally, a thermometer such as a clinical thermometer should have a display for displaying a range of 35.0–42.0 degrees centigrade or 96.8–105.8 degrees Fahrenheit. Therefore, when a single display is provided and celsius and fahrenheit scales are selectively switched, four digit displays are needed for which a display driver circuit should be provided. This prevents the display segment configuration and the driver circuit from becoming simple.

SUMMARY OF THE INVENTION

Accordingly, it is an object of the present invention to provide an improved compact display segment configuration for displaying celsius or fahrenheit temperatures.

It is another object of the present invention to provide an improved display segment configuration directed to a thermometer such as a clinical type for selectively displaying celisius and fahrenheit temperatures. It is a further object of the present invention to provide an improved simple display segment configuration suitable for a celsius and fahrenheit electronic clinical thermometer.

Briefly described, in accordance with the present invention, a display suitable for a Celsius and Fahrenheit clinical thermometer comprises two upper digits for merely displaying figures "3", "4", "9", and "10", and two lower segments for displaying "00" to "99" figures, so as to display 35.0–42.0 degrees Centigrade and 96.8–105.8 degrees Fahrenheit. The two upper segments have such a specific segment configuration that a first digit display is provided which comprises a vertical major segment and a second digit display is provided which comprises two vertical minor segments, three horizontal segments, and one vertical major segment. The vertical major segment of the first digit display is electrically connected to one of the two vertical minor segments of the second digit display.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

In view of the fact that a top digit display of a display of a thermometer such as a clinical thermometer is enough to display only four figures "3" and "4" in the Centigrade scale, and "9" and "1" in the Fahrenheit scale, the purpose of the present invention is to provide such a specific display comprising the two upper digits for displaying the four figures suitable for such a thermometer. This segment configuration can be directed to any type of thermometer as far as it should display a two-scale temperature of celsius and fahrenheit. It should be noted that the application of the present invention is not limited to a clinical thermometer including an electronic type. Further, the type of displaying the display according to the present invention can be adapted to any displaying system, for example, including a liquid crystal display and a light emitting display.

Figure 1:
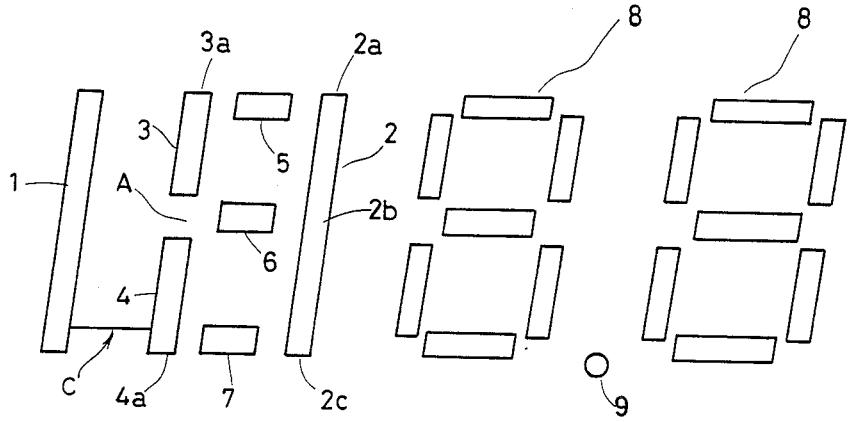
FIG. 1 is a plan view of a display segment for displaying Celsius and Fahrenheit temperatures in a thermometer according to the present invention.
Figure 2:
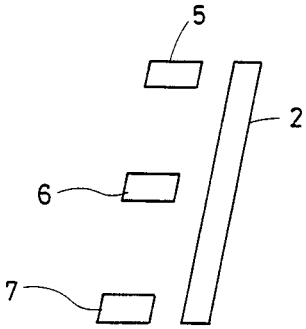
FIG. 2(A) is a display example for displaying figure "3" of the second digit display.
FIG. 2(B) is a display example for displaying figure "4" of the second digit display of FIG. 1.
FIG. 2(C) is a display example for displaying figure "9" of the second digit displays of FIG. 1.
FIG. 2(D) is a display example for displaying figure "10" of the first and second digit displays of FIG. 1.
Figure 2:
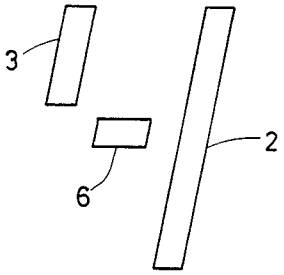
Figure 2:
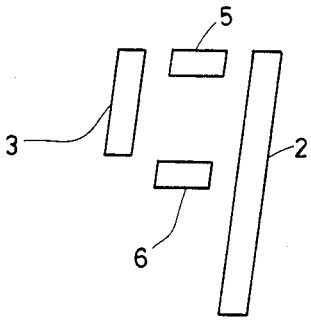
Figure 2:
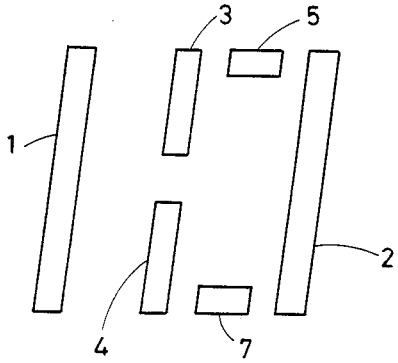

FIG. 1 is a plan view of a display segment configuration for displaying Celsius and Fahrenheit temperatures in a thermometer according to the present invention.

The display 10 of FIG. 1 comprises two upper digit displays, two lower digit displays 8, and a dot 9. A driving means 12 is provided for actuating the display of figures in the display 10. The lower digit displays 8 are conventional and of a minus-in-square. Since the two lower digit displays 8 and the dot 9 do not relate to the gist of the present invention, any further description is omitted.

The two upper digit displays comprise a first vertical segment 1 functioning as a top digit display and a second vertical segment 2 as a second digit display. The segments 1 and 2 are opposed to and in parallel with each other so as to vertically traverse the display area. Between the first and the second vertical segments 1 and 2, a third segment 3 and a fourth segment 4 are positioned in line. The third segment 3 and the fourth segment 4 are parallel with the segments 1 and 2, but the third segment 3 is positioned above the fourth segment 4 with a space A.

A first horizontal segment 5 is provided between a top 2*a* of the second segment 2 and a top 3*a* of the third segment 3. A second horizontal segment 6 is provided between a body 2*b* of the second vertical segment 2, and the space A between the third segment 3 and the fourth segment 4. A third horizontal segment 7 is provided between a bottom 2*c* of the second vertical segment 2 and a bottom 4*a* of the fourth segment 4.

The first vertical segment 1 is electrically coupled to the fourth vertical segment 4 as indicated by line C, so that the display selection of the fourth vertical segment 4 enables the display selection of the first vertical segment 1.

Thus, the two upper digit display has six segments comprising a combined segment of the first vertical segment 1 and the fourth vertical segment 4, the second vertical segment 2, the third vertical segment 3, the first horizontal segment 5, the second horizontal segment 6, and the third horizontal segment 7.

FIGS. 2(A) through 2(D) are display examples for displaying the fourth fingers "3", "4", "9", and "10", respectively.

According to the above described segment configuration, a display driver circuit enough to drive only three digit displays can also drive four digit displays due to the connection between the first digit display and the second digit display. This connection C enables the display driver circuit to only drive three digit displays as the top digit display and the second digit display can merely be considered as one display for the purposes of this circuit. Thus, this circuit permits the display 35.0–42.0 degrees Centigrade and 96.8–105.8 degrees Fahrenheit. The display driver circuit can be simplified.

While only certain embodiments of the present invention have been described, it will be apparent to those skilled in the art that various changes and modifications may be made therein without departing from the spirit and scope of the present invention as claimed.

What is claimed is:

1. A segment arrangement for digitally displaying figures on a display in a thermometer, said display having a first and second portion, said segment arrangement comprising:

first digit display means for selectively displaying at least two figures in the first portion of said display, one of said at least two figures comprising two minor vertical segments and one major vertical segment, said two minor vertical segments being longitudinally aligned to form an upper and a lower minor vertical segments;

second digit display means for displaying a plurality of figures in the second portion of said display;

driving means for actuating the display of figures by said first and second digit display means; and connection means between said lower, minor vertical segment and the other of said at least two figures of said first digit display means, said other of said at least two figures only being actuated when said lower minor vertical segment is actuated by the driving means, the actuation of said other of said at least two figures being permitted by said connection means , said other of said at least two figures of said first display means comprises a vertical major segment which is about the same size as the one major, vertical segment.

2. The segment arrangement of claim 1, wherein said major vertical segment is longer than either of said two minor vertical segments.

3. The segment arrangement of claim 1, wherein said one of said at least two figures additionally comprises a plurality of horizontal segments.

4. The segment arrangement of claim 3, wherein the one of said at least two figures is located to the right of the other of said at least two figures.

5. The segment arrangement of claim 3, wherein the second portion of the display is located to the right of the first portion of the display.

6. The segment arrangement of claim 3, wherein the figure selectively displayed by the other of said at least two figures is a "1" and the figure selectively displayed by the one of said at least two figures is one of a "3", "4", "9" and "0".

7. The segment arrangement of claim 6, wherein the other of said at least two figures is only actuated when the figure of the one of said at least two figures is displayed as a "0".

8. The segment arrangement of claim 1, wherein said segment arrangement is used as a display for a thermometer.

9. The segment arrangement of claim 1, wherein each of said figures displayed by said second digit display means comprise numerals "0" through "9".

* * * * *